United States Patent [19]

Hashimoto et al.

[11] 4,167,949

[45] Sep. 18, 1979

[54] COIN JAMMING DETECTING DEVICE IN COIN SORTING MACHINE

[75] Inventors: Kouichi Hashimoto; Tokunori Kobayashi, both of Himeji, Japan

[73] Assignee: Glory Kogyo Kabushiki Kaisha, Hyogo, Japan

[21] Appl. No.: 824,301

[22] Filed: Aug. 12, 1977

[51] Int. Cl.[2] ..... G07F 3/04

[52] U.S. Cl. ..... 133/3 D; 133/8 R

[58] Field of Search ..... 133/3 R, 3 A, 3 B, 3 C, 133/3 D, 3 E, 3 F, 3 G, 3 H, 8 R; 209/74 R, 74 M

[56] References Cited

U.S. PATENT DOCUMENTS

| | | | |
|---|---|---|---|
| 3,040,858 | 6/1962 | Almguist | 133/3 R X |
| 3,343,672 | 9/1967 | De Vries et al. | 209/74 R |
| 3,352,417 | 11/1967 | Cutaia | 209/74 R |
| 3,500,838 | 3/1970 | Seifert | 133/3 R |

*Primary Examiner*—Joseph J. Rolla

*Attorney, Agent, or Firm*—Wenderoth, Lind & Ponack

[57] ABSTRACT

A plurality of coin detecting switches are provided in the coin passages in a coin sorting machine so that jammed coins are located according to the following principle; when one coin detecting switch detects coins, and the succeeding coin detecting switch detects no coins, it is determined that coins are jammed therebetween.

1 Claim, 3 Drawing Figures

COIN JAMMING DETECTING DEVICE IN COIN SORTING MACHINE

BACKGROUND OF THE INVENTION

This invention relates to coin sorting machines for sorting coin according to their denominations, and more particularly to a coin jam detecting device in a coin sorting machine.

In a conventional coin sorting machine of this type, mixed coins loaded therein are sorted according to the differences in diameter for instance, and the coins thus sorted are counted separately according to the denominations. In a coin sorting machine capable of sorting out coins of relatively many different denominations, a relatively long coin sorting path is required, running from a main coin supplying mechanism through a coin sorting section to a coin counting mechanism. Accordingly, the flow of coins is liable to be interrupted, for instance, by deformed coins which may be mixed with the coins to be sorted; that is, a coin jam is liable to occur in such a long coin sorting path. This tendency is increased as the number of coins to be sorted and/or the rate of sorting coins is increased. In general, it is troublesome to locate the coin jam in such a long path, and it takes a relatively long time, which leads to a decrease in the efficiency of the machine.

SUMMARY OF THE INVENTION

Accordingly, an object of this invention is to eliminate the above-described difficulties accompanying conventional coin sorting machines.

More specifically, an object of the invention is to provide a coin jam detecting device in a coin sorting machine, by which any coin jam caused during the operation can be readily and quickly detected to thereby increase the efficiency of the machine.

The foregoing object and other objects of this invention have been achieved by the provision of a coin jam detecting device in a coin sorting machine having a main coin supplying mechanism, a plurality of coin sorting sections for sorting coins supplied from the main coin supplying mechanism, sorted coin delivery sections provided for the respective coin sorting sections to deliver the sorted coins into respective sorted coin containers, and coin counting mechanisms provided for the respective sorted coin delivery sections, for counting coins delivered by the sorted coin delivery sections. This device, according to the invention comprises a first detecting switch means for detecting coins supplied from the main coin supplying mechanism, second detecting switch means for detecting coins in the respective coin sorting sections, and third detecting switch means for detecting coins in the respective sorted coin delivering mechanisms. If, when the first detecting switch means detects a coin, the second detecting means and/or the third detecting switch means do not detect a coin, it is determined that coins are jammed in the main coin supplying mechanism. If, when a second detecting switch means detects a coin, the corresponding third detecting switch means does not detect a coin, it is determined that coins are jammed in the corresponding coin sorting section.

The nature, principle, and utility of the invention will become more apparent from the following detailed description and the appended claims when read in conjunction with the accompanying drawings.

DETAILED DESCRIPTION OF THE INVENTION

A preferred embodiment of a coin sorting machine with a coin jam detecting device will be described with reference to the accompanying drawings.

Figure 1:
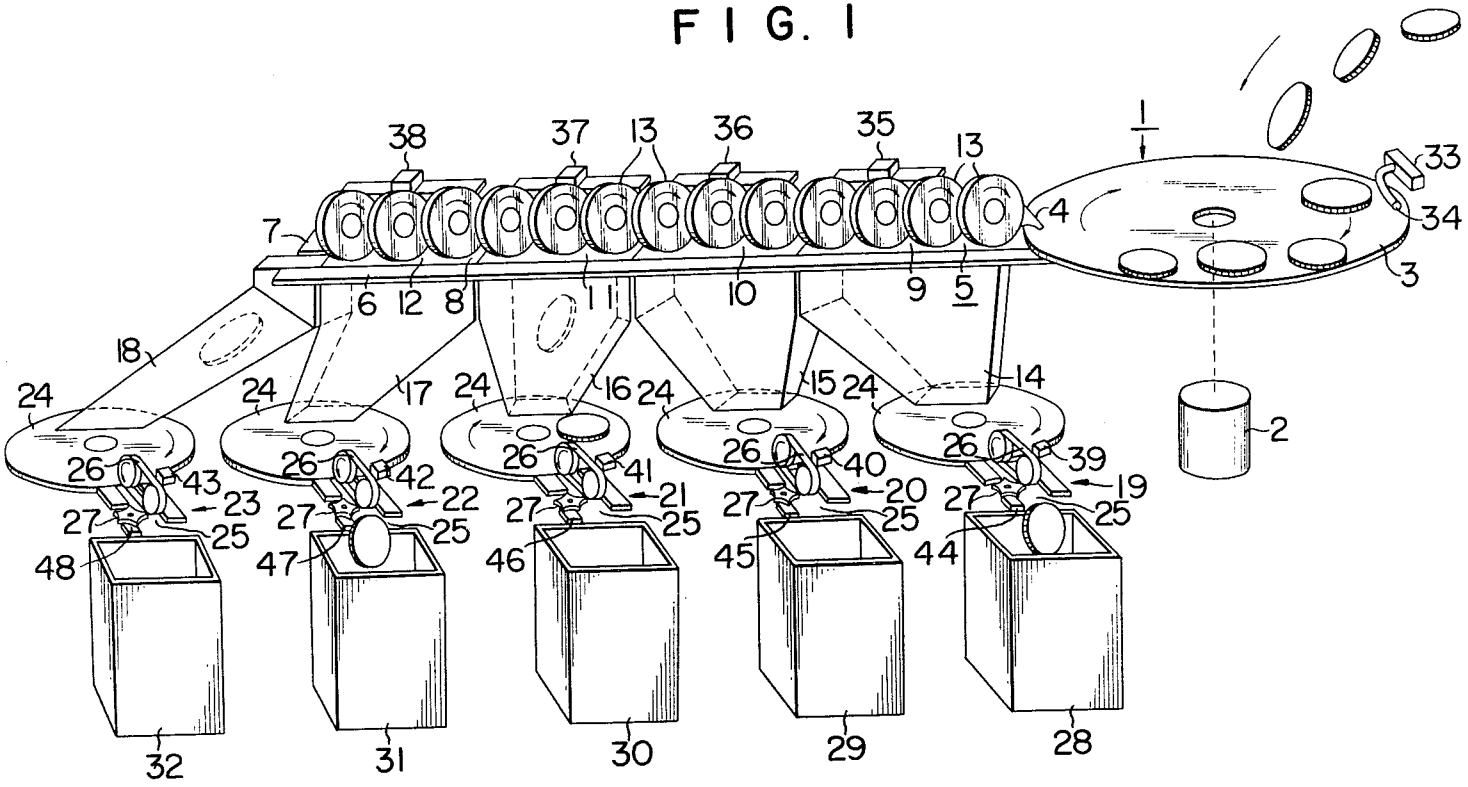
FIG. 1 is a perspective view illustrating the essential parts of a coin sorting machine provided with a coin jam detecting device according to this invention.

In FIG. 1, reference numeral 1 designates a main coin supplying mechanism, which comprises: a rotary disk 3 driven by an electric motor 2; and a guide member 4 protruding above the rotary disk 3 so as to guide coins which are supplied from a hopper (not shown) onto the rotary disk 3 and are aligned along the periphery of the rotary disk 3 by centrifugal force. By the guide member 4, the coins are delivered one by one into a coin sorting path 5 extending from the rotary disk 3.

The coin sorting path 5 is provided with two elongated guide control members 6 and 7 along its two sides in such a manner that a coin sliding surface 8 is defined between the guide control members 6 and 7. In the coin sliding surface 8 there are provided a plurality of coin sorting sections 9 through 12 which are rectangular openings each having a first side aligned perpendicular to coin sorting path 5 and an opposite side spaced from the first side according to the diameters of coins to be handled by the machine. At least one conveying roller 13 adapted to slide coins along the coin sorting path 5 is provided above the path 5 for each of the coin sorting sections 9 through 12. These are mounted on respective shafts in a direction oblique with respect to the coin conveying direction, or the longitudinal axis of the coin sorting path, as shown in FIG. 1. These conveying rollers 13 operate to convey coins loaded on the coin sorting path 5, pushing each coin against the guide control member 6, as a result of which the coins thus conveyed are dropped through the respective openings in the order of the diameters of the coins. That is, if it is assumed that 1-yen, 50-yen, 5-yen, 100-yen, and 10-yen coins in the Japanese monetary system (whose diameters increase in the described order) are sorted by the machine, 1-yen coins are first dropped through the first opening, 50-yen coins are next dropped through the next opening, and so forth. However, it should be noted that no opening is provided for 10-yen coins, and 10-yen coins are allowed to pass through the coin sorting path 5 and to drop into a sorted coin delivery section 18 (described later).

Sorted coin delivery section 14, 15, 16, and 17 are provided under the respective coin sorting sections 9, 10, 11, and 12 in a manner such that the coin sorting sections communicate with the sorted coin delivery sections. In addition, the above-described coin delivery section 18 for 10-yen coins is provided at the end of the coin sorting path 5.

The sorted coin delivery sections 14, 15, 16, 17, and 18 have opening at their respective lower end portions, so that the sorted coins are dropped through the openings onto the rotary disks 24 of coin counting mechanisms 19, 20, 21, 22, and 23, respectively. The coin counting mechanisms 19 through 23 are each designed so that coins received on the rotary disk 24 are delivered by the centrifugal force thereof one after another to a coin counting path 25. An endless conveyor belt 26 is provided above each coin counting path 25 to slide the coins along the path 25. In each coin counting path 25, there is provided a counting ring 27 which is turned through a predetermined angle by a coin passing through the coin counting path 25. Thus, the sorted coins are counted separately according to their denominations by the respective counting rings 27. When a predetermined number of coins is counted by the counting ring 27, the latter is mechanically locked so as to block the flow of coins on the respective coin counting path.

The coins which pass through the coin counting paths provided separately according to the denominations are allowed to drop into respective coin containers 28 through 32 provided separately according to the denominations.

In FIG. 1, reference numeral 33 designates a coin detecting switch for detecting the number of coins supplied to the coin supplying mechanism 1. The coin detecting switch 33 is operated by a lever 34 which is actuated by coins on the rotary disk 3, to thereby count the number of coins supplied to the coin supplying mechanism.

In the coin sorting path 5 are provided intermediate coin detecting switches 35, 36, 37 and 38 for the respective coin sorting sections 9, 10, 11 and 12, for detecting the presence or absence of coins on the coin sorting path 5. These switches 35, 36, 37, and 38 are operated by the upward movement of the respective conveying rollers 13 caused by coins conveyed along the coin detecting path 5.

The coin counting mechanisms 19, 20, 21, 22, and 23 are further provided with coin detecting switches 39, 40, 41, 42, and 43, respectively, each of which is disposed between the rotary disk 24 and the coin counting path 25 of the corresponding coin counting mechanism for operation in response to the presence or absence of a coin delivered to the coin counting path 25 from the rotary disk 24.

Coin counting and detecting switches 44, 45, 46, 47 and 48 are operated by the predetermined angle rotation of the counting rings 27 in the coin counting mechanisms 19, 20, 21, 22, and 23, respectively, so as to simultaneously count and detect a coin.

The operation of the machine thus organized will be described in detail.

A number of coins to be sorted out are loaded in the hopper, and are introduced onto the coin sorting path 5 one after another with the aid of the centrifugal force of the rotary disk 3. The coins thus introduced are conveyed along the edge of the guide control member 6 on one side of the coin sorting path 5 by the conveying rollers 13, and are sorted out according to the different diameters thereof. The coins thus sorted out are allowed to drop through the respective sorted coin delivering sections 14 through 18 onto the respective rotary disks 19 through 23. The sorted coins on each rotary disk 24 are further delivered one by one to the coin counting path 25 by the centrifugal force of the rotary disk 24. The coin thus delivered causes the counting ring 27 to turn through its predetermined angle, and is then allowed to drop into the respective money container. Thus, all of the sorted coins are put in the respective money containers 28 through 32.

Each of the coin counting and detecting switches 44 through 48 is operated by the predetermined angle rotation of the counting ring 27 as was described. In this connection, the coins may be electrically counted by the use of electrical counting signals.

Now, a coin jamming detecting device according to the invention will be described with reference to a circuit diagram shown in FIG. 2. It should be noted that for simplification of description the circuit is for detection of coin james of only three denominations (1-yen, 50-yen, and 5-yen).

Figure 2A:
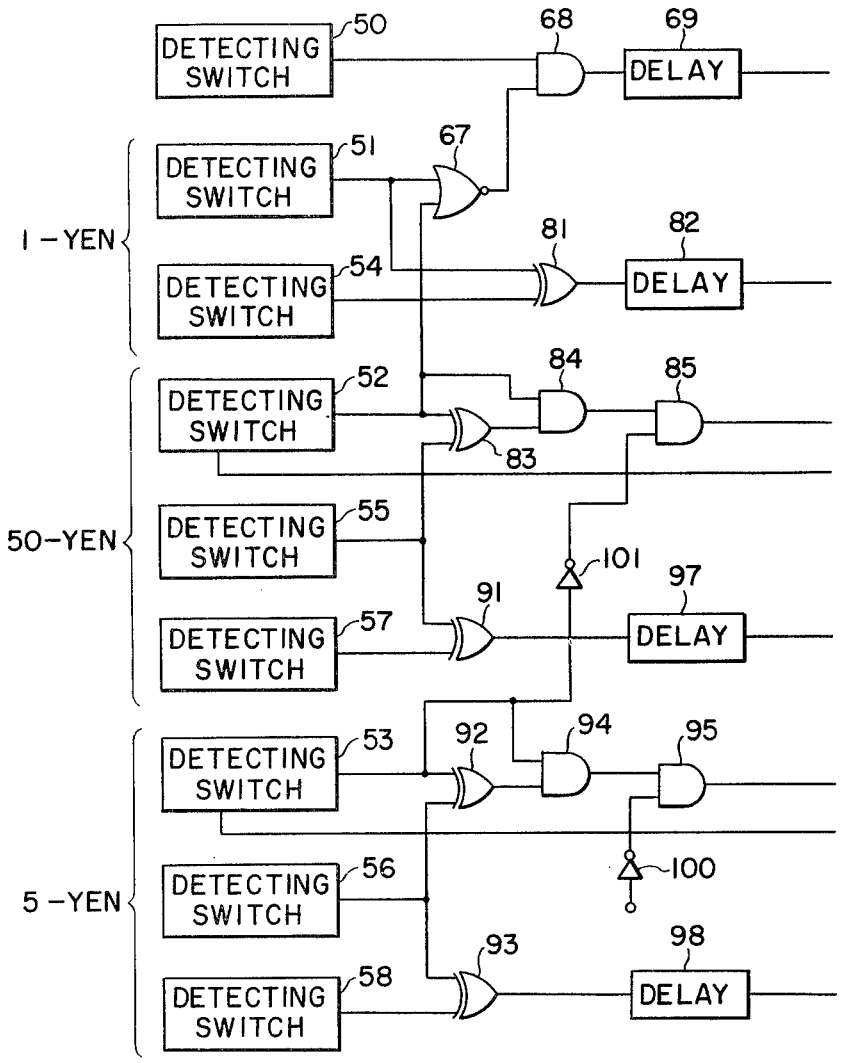
FIGS. 2A and 2B are two parts of a circuit diagram showing the coin jam detecting device.

In FIG. 2A, reference numeral 50 is a coin-supplying-quantity detecting switch means which, when the coin detecting switch 33 (FIG. 1) detects coins for a predetermined period of time, or produces coin detection signals for a predetermined period of time, produces a high level signal (hereinafter referred to merely as a "H" signal, when applicable); that is, it produces the "H" signal by delaying the detection signal for about three seconds, for instance.

The circuit further comprises: coin-introduction detecting switch means 51, 57, and 58; counting detecting switch means 54, 55, and 56; and intermediate detecting switch means 52 and 53, as shown in FIG. 2A.

The coin-introduction detecting switch means 51 (or 57 or 58) operates to produce a "H" signal when the coin detecting switch 39 (or 40 or 41) in the coin counting mechanism 19 (or 20 or 21) has detected the corresponding coins for a predetermined period of time, and to allow the detection signal of the switch 39 (or 40 or 41) to be produced with a delay time of the order of three seconds, for instance.

The counting detecting switch means 54 (or 55 or 56) operates to produce a "H" signal when the switch 44 (or 45 or 46) in the coin counting mechanism 19 (or 20 or 21) has detected the corresponding coins for a predetermined period of time, and to allow the detection signal of the switch 44 (or 45 or 46) to be produced with a delay time of the order of three seconds.

The intermediate detecting switch means 52 and 53 operate to produce "H" signals when the coin detecting switches 35 and 36 in the coin sorting path 5 output coin detection signals for predetermined periods of time, and to allow the signals from the respective switches 35 and 36 to be produced with a delay time of the order of three seconds.

The detecting switch means 51 and 54 deal with the first coins, or 1-yen coins; the detecting switch means 52, 55, and 57 deal with the second coins, or 50-yen coins; and the detecting switch means 53, 56, and 58 deal with the third coins, or 5-yen coins.

Reference numeral 59 (FIG. 2B) designates a first coin jam display section which operates to indicate a jam of the first coins in the first coin sorting section 9 or on the rotary disk 24 of the first coin counting mechanism 19. More specifically, this display section 59 provides an indication when the coin detecting switch 33 has detected a coin for the predetermined period of time while neither the coin detecting switch 35 nor 39 has detected coins for the predetermined period of time.

A second coin jam display section 60 indicates a jam of the first coins in the coin counting path 25 of the first coin counting mechanism 19. More specifically, the display section 60 provides an indication when either the switch 39 or the switch 44 in the first coin counting mechanism 19 but not both has detected a coin for the predetermined period of time.

A third coin jam display section 62 indicates a jam of second coins in the coin counting path 25 of the second coin counting mechanism 20. This display section 62 indicates when either the switch 40 or the switch 45 in the second coin counting mechanism 20 but not both has detected a coin for the predetermined period of time.

Similarly as in the third coin jam display section, a fourth coin jam display section 63 indicates a jam of third coins caused in the coin counting path 25 of the third coin counting mechanism 21. This display section 63 indicates when either the switch 41 or the switch 46 in the third coin counting mechanism 21 but not both has detected a coin for the predetermined period of time.

Reference numeral 64 designates a fifth coin jam display section. If, when the coin, detecting switch 35 in the coin sorting path 5 has detected a coin for the predetermined period of time, both the switch 45 in the second coin counting mechanism 20, and the switch 36 in the coin sorting path 5 have detected no coins, the fifth coin jam display section 64, provides an indication. Furthermore, the display section 64 also provides an indication in the case when the second coin detecting switch 36 in the coin sorting path 5 has detected a coin for the predetermined period of time, and both the coin detecting switch 46 of the third coin counting mechanism 21 and the third coin detecting switch 37 in the coin sorting path 5 have detected no coins. Thus, the display section 64 can display the jam of coins between the coin sorting section 10 and the coin counting mechanism 20, and the jam of coins caused between the coin sorting section 11 and the coin counting mechanism 21.

It goes without saying that, for dealing with the jamming of 100-yen and 10-yen coins, it is possible to provide circuits similar to the above-described circuit for dealing with the jamming of 5-yen and 50-yen coins.

When any of the display sections 59 through 64 indicates a jam of coins, a stop control section 65 operates to stop the operation of the coin sorting machine.

A terminal 66 is to clear the memory as to the jammed coins, or to erase the display of the jammed coins, if any, when the power switch of the coin sorting machine is turned on or when the operation of the apparatus is started again after the jammed coins have been removed.

Figure 2B:
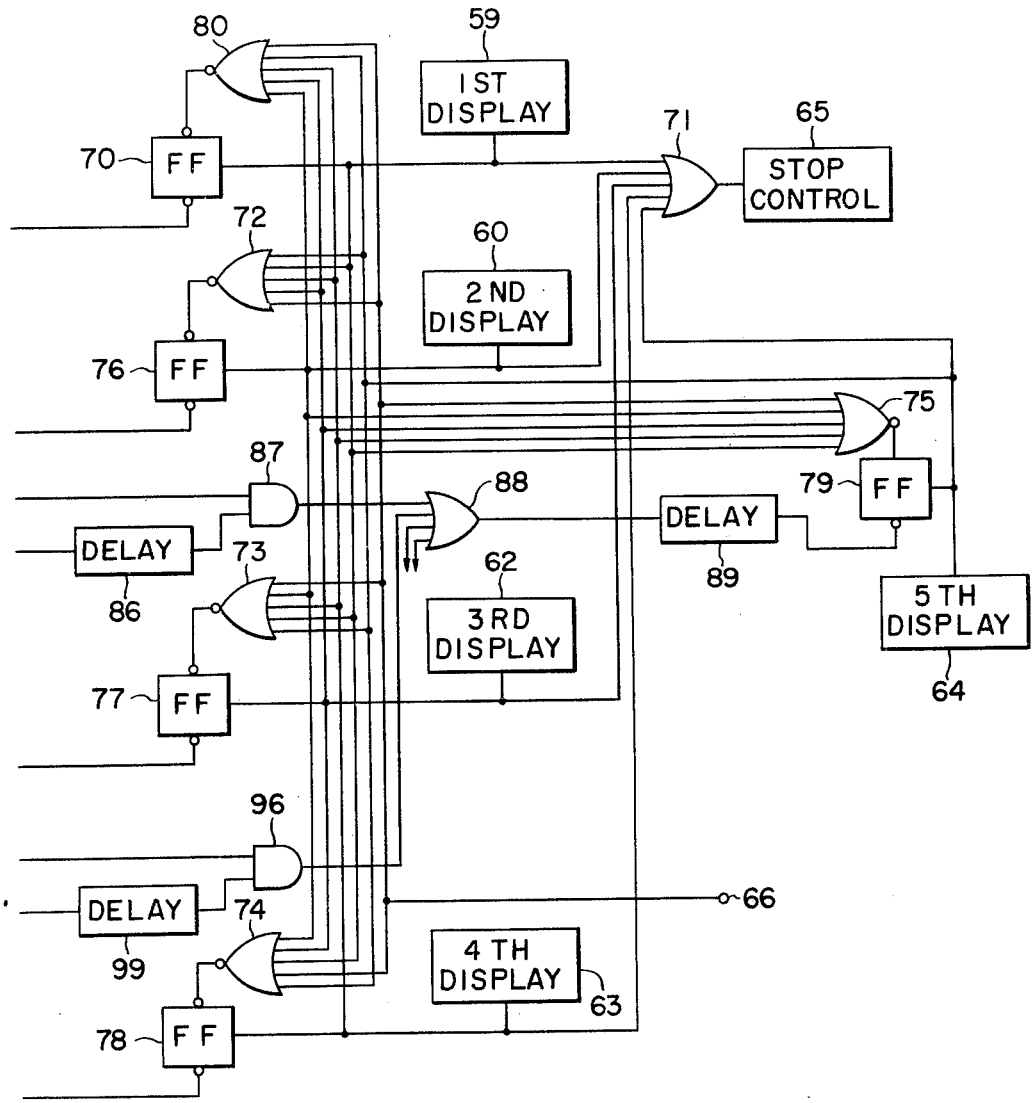

The operation of the circuit shown in FIGS. 2A and 2B will be described.

When the coin detecting switch 33 in the coin supplying mechanism 1 has detected coins for the predetermined period of time, the first detecting switch means 50 produces the "H" signal. If in this case the coin detecting switch 39 in the first counting mechanism 19 and the coin detecting switch 35 in the coin sorting path 5 have detected no coins, an "H" signal is produced by an AND gate 68 through the detecting switch means 51 and 52 and a NOR gate 67. This "H" signal is delayed for about three seconds by a delay circuit 69, to confirm the occurrence of a coin jam. The "H" signal thus delayed serves to set a flip-flop circuit 70, the output of which causes the first coin jam display section 59 to indicate a jam of coins caused in the first coin sorting section 9 or on the rotary disk 24 in the first coin counting mechanism 19, for instance, by turning on a lamp. The output of the flip-flop circuit 70 is further applied to the stop control section through an OR circuit 71 so as to stop the operation of the machine, whereby the jammed coins in these sections can be detected. In this operation, on the other hand, other flip-flop circuits 76, 77, 78, and 79 are locked through NOR gates 72, 73, 74, and 75 so as to prohibit the display operations of the other coin jam display sections 60, 62, 63 and 64, respectively.

After removal of the jammed coins, the machine is started again. In this case, the flip-flop circuits 70, 76, 77, 78, and 79 are reset through the respective NOR gates 80, 72, 73, 74, and 75 by a start signal applied through the terminal 66, and the display on the display section 59 is erased, for instance, by turning off the lamp while the stop control section 65 is rendered inoperative.

When either of the detecting switch means 51 or 54 but not both has detected a coin for the predetermined period of time through the switches 39 and 44 in the first coin counting mechanism, the flip-flop circuit 76 is set through an exclusive OR gate 81 and a delay circuit 82, and in response to the output of the flip-flop circuit 76 the display section 60 provides an indication of a coin jam while the stop control section 65 is operated to suspend the operation of the machine. On the other hand, the output of the flip-flop circuit 76 is further applied through the NOR gates 80, 73, 74 and 75 to the flip-flop circuits 70, 77, 78 and 79 to reset the latter flip-flop circuits and thereby prohibit the display operations of the display sections 59, 62, 63 and 64, respectively.

In order to start the machine again, the start signal is applied through the terminal 66. As a result, the flip-flop circuit 76 is reset, the display indicating a coin jam is erased, and the stop control section 65 is released.

The indication of a jam of 50-yen coins and of a jam of 5-yen coins are carried out in a manner similar to that described above.

If the detecting switch means 52 with the switch 35 of the coin sorting path 5 has detected coins for the predetermined period of time but the detecting switch means 55 with the switch 39 of the first coin counting mechanism has not detected coins, an "H" signal is produced from an AND gate 84 through an exclusive OR gate 83. In this case, if the second coin sorting path 5 is not detecting coins, then the detecting switch means 53 produces an "L" signal, which is applied to an AND gate 85 through an inverter 101, and therefore the AND gate 85 provides an "H" signal. If in this case the signal from the switch 35 is detected for a predetermined period of time (approximately three second, for instance) by a delay circuit 86, the "H" signal is applied through an AND gate 87, an OR gate 88, and a delay circuit 89 to the flip-flop circuit 79 to set the latter. As a result, the display section 79 indicates the occurrence of a coin jam on the coin sorting path 5. On the other hand, the stop control section 65 is operated through an OR gate 71 to suspend the operation of coin sorting machine. After removal of the jammed coins, the start signal is applied through the terminal 66 to reset the flip-flop circuit 79. As a result, the display of the display section 79 is erased, and the coin sorting operation is started again.

In addition, in the circuit shown in FIG. 2A, reference numeral 100 is an inverter to which the detection signal from the third detecting switch 37 in the coin sorting path 5 may be applied. Detection signals representative of the jamming of other coins (such as 100-yen or 10-yen coins not shown) may be applied to the OR gate 88.

Furthermore, in FIG. 2 reference numerals 91, 92, and 93 designate exclusive OR gates; reference numerals 94, 95, and 96, AND gates; and reference numerals 97, 98, and 99, delay circuits.

As is apparent from the above description, according to the invention location of where in the coin sorting machine a coin jam occurs can be quickly and readily achieved, which leads to an improvement in performance of the coin sorting machine.

What is claimed is:

1. An improved coin jam detecting device in a coin sorting machine having a main coin supplying mechanism for supplying coins, a plurality of successive coin sorting sections for sorting coins supplied from said main coin supplying mechanism according to their denominations, a plurality of sorted coin delivery mechanisms connected to corresponding ones of said coin sorting sections for delivery of sorted coins from said corresponding coin sorting section, a plurality of coin counting mechanisms connected to corresponding ones of said sorted coin delivery mechanisms for counting coins delivered by said corresponding sorted coin delivery mechanism, and a plurality of coin containers connected to corresponding ones of said coin counting mechanisms for storing therein coins counted by said corresponding coin counting mechanism, said improved coin jam detecting device comprising:

(a) a coin supply detecting means connected to said main coin supplying mechanism for detecting coins in the main coin supplying mechanism;

(b) a plurality of intermediate coin detecting means connected to corresponding ones of said coin sorting sections for detecting coins in said corresponding coin sorting section;

(c) a plurality of sorted coin detecting means connected to corresponding ones of said sorted coin delivery mechanisms for detecting coins delivered by said corresponding sorted coin delivery mechanism;

(d) a plurality of counted coin detecting means connected to corresponding ones of said coin counting mechanisms for detecting coins counted by said corresponding coin counting mechanism; and (e) a control circuit and indication means connected to said coin supply detecting means, said intermediate coin detecting means, said sorted coin detecting means, and said counted coin detecting means (1) for indicating a coin jam in said main coin supplying mechanism when said coin supply detecting means detects coins for longer than a predetermined period and neither said intermediate coin detecting means nor said sorted coin detecting means has detected coins during said predetermined period, (2) for indicating a coin jam in one of said coin counting mechanisms when either said corresponding sorted coin detecting means or said corresponding counted coin detecting means but not both said detecting means detects coins for a predetermined period, and (3) for indicating a coin jam in one of said coin sorting sections when said corresponding intermediate coin detecting means detects coins for a predetermined period and neither the intermediate coin detecting means corresponding to the next succeeding coin sorting section nor the counted coin detecting means corresponding to the next succeeding coin sorting section has detected coins during said predetermined period.

* * * * *